United States Patent [19]

Mioduski

[11] 4,187,562

[45] Feb. 12, 1980

[54] PERSONAL URINAL DEVICE FOR FEMALES

[76] Inventor: Victoria F. Mioduski, 1226 N. Torino Ave., Tucson, Ariz. 85712

[21] Appl. No.: 902,888

[22] Filed: May 4, 1978

[51] Int. Cl.[2] ..... A61G 9/00; A47K 11/12

[52] U.S. Cl. ..... 4/144.3; 128/295

[58] Field of Search ..... 4/144.1, 144.2, 144.3, 4/144.4, 112, 113, 113.1; 128/2 F, 295, 275; D24/51, 56, 57; 215/1 C; 220/1 C

[56] References Cited

U.S. PATENT DOCUMENTS

| | | | |
|---|---|---|---|
| 1,227,022 | 5/1917 | Thompson | 4/112 |
| 1,951,871 | 3/1934 | Judah | 4/144.3 X |
| 2,542,276 | 2/1951 | Felts | 4/112 X |
| 2,582,398 | 1/1952 | Siegenthal | 4/112 X |
| 3,116,734 | 1/1964 | Terman | 128/295 |
| 3,680,543 | 8/1972 | Cox | 4/144.1 X |
| 3,815,581 | 6/1974 | Levin | 4/144.3 |
| 3,864,759 | 2/1975 | Horiuchi | 128/295 |
| 3,963,020 | 6/1976 | Hall | 4/144.3 X |
| 3,964,111 | 6/1976 | Packer | 4/144.4 |
| 4,023,216 | 5/1977 | Li | 4/112 |

FOREIGN PATENT DOCUMENTS

| | | | |
|---|---|---|---|
| 194836 | 6/1964 | Sweden | 4/144.3 |

*Primary Examiner*—Stuart S. Levy

*Attorney, Agent, or Firm*—Cahill, Sutton & Thomas

[57] ABSTRACT

A semi-rigid collector receives and contains urine discharged by a female in a sitting position. One end of the collector is configured to create a seal against the outer edges of the labium. The central section of the collector channels the flow of urine to the container end and includes concave sides configured to follow the curvature of the thighs and help maintain the collector in place during urination. The container end of the collector serves, in conjunction with the central section, as a depository for the urine during collection and as a storage compartment until disposal of the urine can be effected.

8 Claims, 4 Drawing Figures

PERSONAL URINAL DEVICE FOR FEMALES

The present invention relates to urinal devices and, more particularly, to personal urinal devices for females.

Various devices have been developed for collecting urine from females to permit voiding of the bladder into a container or for collecting urine specimens. In example, U.S. Pat. No. 3,680,543, is directed to a device for taking a specimen from the mid-stream of micturition after the urethra has been flushed by a flow from the bladder. U.S. Pat. No. 3,815,581, is directed to a device for obtaining a specimen free of extra urethral contamination and includes a channel or trough member partially inserted into the vaginal passage. U.S. Pat. No. 3,864,759 illustrates a funnel-like device for conveying urine to a point external to the body from the urethra.

U.S. Pat. Nos. 3,964,111 and 4,023,216 describes devices which direct the urine to a container or the like when voiding of the bladder is effected from a female in a standing position. U.S. Pat. Nos. 3,116,734 and 3,963,020, describe urine collection devices which necessitate the insertion of an element into the vaginal passage to maintain the devices in place.

With age and/or disease, many women may be temporarily or permanently restricted to wheelchairs for ambulation. When women so restricted are also incapable of removing themselves to a toilet for urination, they must either receive assistance from other persons or undergo the physical exertions attendant the use of a conventional bedpan. The need for help from other persons is frustrating, demeaning and even embarrassing. The use of bedpans requires substantial physical effort which many women may not be capable of providing; moreover, even when used, the woman or her clothing often become soiled.

The use of catheters inserted into the urethra or devices which require insertion of a member into the vaginal passage immediately presents the risk of injury and infection. Moreover, because of the physical impairment which necessitates a woman's confinement to a wheelchair or seated position, she is usually not physically capable of inserting and removing catheters or other devices which require penetration of a body orifice. The use of funnel-like devices may be useable by such a woman, but an additional container must be employed to collect the urine; the use of two elements is awkward, clumsy and often results in spillage.

The present invention is an elongated member having one end configured to sealingly mate with the outside edges of the labium whereby an effective seal is formed and contact of the urine with the surface area of the body is minimized. The central section is configured to mate with the user's thighs to help maintain the device in place during urination. Additionally, the central section serves to channel the urine to the other end of the device wherein the collected urine is contained during urination and stored until disposal can be effected.

It is therefore a primary object of the present invention to provide an easily useable urinal for women when in a seated position.

Another object of the present invention is to provide a personal urinal for women which does not require the user to raise her hips off a supporting surface.

Yet another object of the present invention is to provide a personal urinal for women which does not penetrate any body orifices.

A further object of the present invention is to provide a personal urinal for women which minimizes the body surface potentially coming into contact with discharged urine.

A yet further object of the present invention is to provide a personal urinal for women useable by a woman when in a supine position.

A still further object of the present invention is to provide an inexpensive personal urinal for women with ambulatory difficulties.

These and other objects of the present invention will become apparent to those skilled in the art as the description thereof proceeds.

The present invention may be described with greater specificity and clarity with reference to the following drawings, in which.

Women, who, because of age, disease or physical infirmity, are no longer freely ambulatory and are relegated to wheelchairs for ambulation suffer from personally severe problems attendant urination. Similarly, women who are bedridden in a supine position and who are either not capable of raising their hips by themselves or where such movement is limited because of surgery or pain, severe problems of various types have existed attendant the normal multi-daily function of urination. The choices so far have been that of either using a conventional bedpan which, more often than not, required the assistance of another person, using a catheter inserted into the urethra, or using a device maintained in place by inserting an element thereof into the vaginal passage.

Although urine is collected for disposal by any of these three devices, they entail both primary problems and secondary problems. The primary prolems are essentially those of requiring the assistance of another person in locating any of these devices in place for use and removing them. The secondary problems are those which result from seemingly unavoidable contamination by urine of the body of the women and the resulting danger of tissue damage and infection. The devices inserted within an orifice of the body necessarily impose the danger of injury and infection. A third type of problem also exists which, though essentially psychological, can be very demeaning to the id of the user. That is, the woman may feel totally frustrated in not being able to perform such a simple natural function as urination without the aid an assistance of another person. Since all of these problems, directly or indirectly, have an adverse effect upon the well being of the woman, whether from the medical or mental standpoint, these problems should be obviated to the extent possible.

Figure 1:
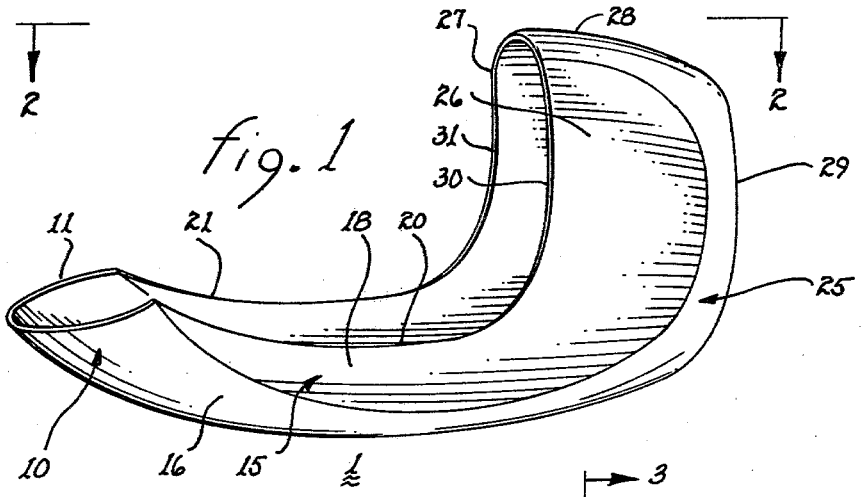
FIG. 1 is a perspective view of a personal hygenic urinal for women.
Figure 2:
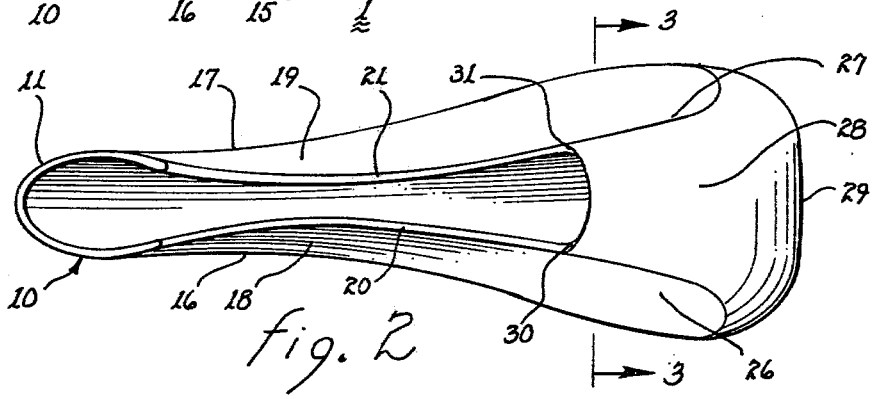
FIG. 2 is a top view taken along lines 2—2, as shown in FIG. 1.
Figure 3:
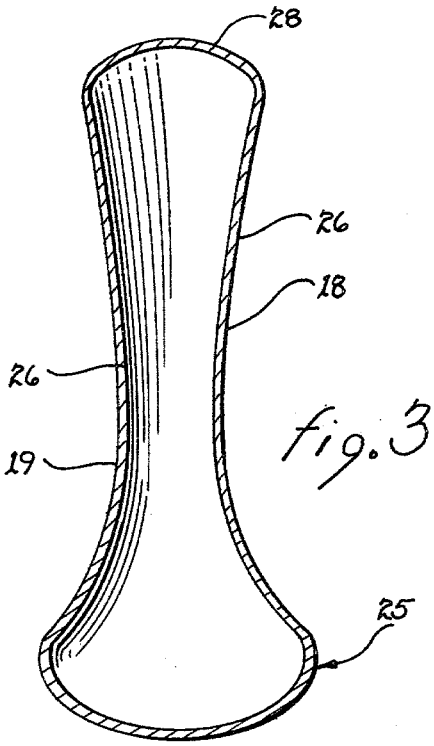
FIG. 3 is a cross-sectional view taken along lines 3—3, as shown in FIG. 2.

Referring to FIGS. 1, 2 and 3, there is illustrated a personal urinal for women which is useable in the configuration illustrated by a woman in the seated position. Moreover, either as illustrated or with slight modification of the curvature thereof, it is useable by a woman when in a supine position.

The urinal includes a receiving end 10 for receiving urine discharged from the urethra. It is generally channel-shaped in cross-section and includes a lip 11 which bears against the outer edges of the labium. The lips may be defined by a plane extending transversely through the channel-shaped receiving end such that the bottom of the lip extends longitudinally beyond the terminal ends of the lip which terminal ends are coincident with the upper opposed edges of the receiving end. Thereby, the lip is easily placed in position for use of the urinal, it serves as an effective seal to minimize seepage of urine along the surface of the user's body and it permits unrestricted discharge of urine. The cross-sectional channel-like configuration, sloping downwardly away from lip 11, urges the flow of the urine away from the lip and the user's body.

Central section 15 resembles an elongated channel for conveying the discharged urine and curves downwardly to a low point to urge flow of the urine away from lip 11. Lateral walls 16 and 17 of the central section are indented by concave sections 18 and 19 and generally conform with the respective curvature of at least the lower portion of the user's inner thighs. Thereby, the user's thighs tend to maintain urinal 1 in place during urination.

Container section 25 is a continuation of central section 15 with upwardly extending walls 26 and 27 curving around to join one another along upper extremity 28. Additionally, walls 26 and 27 curve around toward one another to define base end 29, which base end may be flattened. As will be noted from the figures, the indentation represented by concave sections 18 and 19 extend to and are part of walls 26 and 27 which extend above the midpoint of the user's thighs when the urinal is in use. The upper edges 20, 21 of walls 16 and 17, along with the forward edges 30, 31 of walls 26 and 27, are configured to avoid as much material as possible intermediate the user's thighs while still providing sufficient wall height at central section 15 to channel and contain the flow of urine. As illustrated, edges 20 and 30 and edges 21 and 31 define a general "J" shape when the urinal is viewed from the side. By minimizing the amount of material intermediate the user's thighs, comfort during use of urinal 1 is greatly enhanced.

Figure 4:
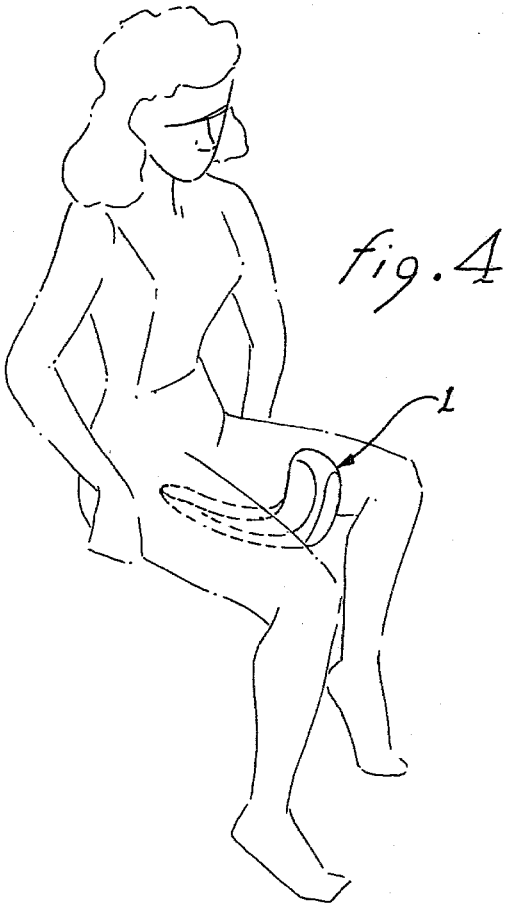
FIG. 4 illustrates a mode of use of the urinal.

With reference to FIG. 4, the use of urinal 1 will be described. Before the onset of urination, urinal 1 is located between the user's thighs and slid along a supporting surface, such as a chair seat or mattress, until lip 11 is located adjacent the outside edges of the labium and partially circumscribes the orifice of the urethra. In this position, the orifice of the urethra is physically at a height greater than the height of the bottom of lip 11 and the bottom of central section 15 which results in a flow of urine from receiving end 10 into the central section. The flow may also extend into container 25. Necessarily, the length of urinal 1 must be sufficient to contain a normal discharge of urine within the central section and partially within the receiving end and container. When being used, urinal 1 is readily and solidly maintained in place by the user simply bringing her thighs together to bear against concave sections 18 and 19.

After urination is complete, the urinal is slid away from the user and thence tilted by raising receiving end 10. Such tilting will cause the collected urine to flow into container 25. Because of the container's high walls 26, 27, and the resulting substantially greater storage capacity than that of central section 15, the level of the urine in the container will be substantially below edges 30 and 31. The extra wall height will preclude spillage of urine even though movement of the urinal may cause some sloshing of the urine. Thereafter, the urinal may be easily emptied into a suitable receptacle by the user; alternatively, the user may place the urinal on end and resting upon flattened base end 29 until such time as the user or a third person has an opportunity to empty it.

Although the present invention was conceived for the purpose of providing a personal urinal for women relegated to wheelchairs or who can assume a sitting position in bed, it has been learned through experimentation that it serves admirably well for bedridden women in the supine position. For such use, central section 15 may have to be slightly elongated in order to accommodate the necessary volume possibly required by reducing the curvature thereof and lowering the lower end of lip 11. Such lowering might be necessary because of the change in height of the urethra orifice when the user is in a supine position as compared to the height of the orifice when the user is in a seated position. It may be noted that it is unnecessary for the user to have to raise her hips in order to use urinal 1. This feature may be of extreme importance when such movement cannot be accomplished without pain or without potential damage to tissue because of surgery.

While the principles of the invention have now been made clear in an illustrative embodiment, there will be immediately obvious to one skilled in the art many modifications of structure, arrangement, proportions, elements, materials, and components, used in the practice of the invention which are particularly adapted for specific environments and operating requirements without departing from those principles.

I claim:

1. A semi-rigid personal urinal for collecting urine from women, said urinal being useable by a woman while she is in a sitting or supine position by placing said urinal upon the same surface supporting the user, said urinal comprising in combination:

(a) a receiving end for receiving urine discharged from the orifice of the urethra, said receiving end including a lip for sealingly engaging a part of the labium;

(b) a central section continuous with said receiving end and having a longitudinal axis and extending longitudinally from said receiving end for channeling the urine away from said lip, said central section being of sufficient capacity to receive and retain a substantial part of the discharged urine, said central section including opposed walls having concave wall sections for contactingly engaging at least the lower part of the adjacent portions of the user's thighs and through such engagement constraining movement of said urinal relative to the user's thighs and urethra;

(c) a container disposed downstream of and continuous with said central section, said container being configured to store the collected urine upon rotation of said urinal from a horizontal position to a vertical position, said container including an upright portion extending vertically from the longitudinal axis of said central section for a distance sufficient to place the upper end of said upright section above the mid point of the user's thighs when said urinal is in use, said upright portion including further wall sections extending from said wall sections of said central section for engaging the adjacent surfaces of the user's thighs, said further wall sections including concave sections for contactingly receiving at least the mid points of the user's thighs and constraining vertical and horizontal movement of said urinal with respect to the user's thighs;

whereby, said urinal is maintained in place by contact with the user's thighs and is accessible by the upper end of said upright portion before, during and after use.

2. The urinal as set forth in claim 1 wherein said receiving end is U-shaped in cross-section.

3. The urinal as set forth in claim 2 wherein said lip is defined by a plane transversely intersecting said receiving end.

4. The urinal as set forth in claim 3 wherein said central section is U-shaped in cross-section.

5. The urinal as set forth in claim 4 wherein opposed ends of the bottom of said central section curve in the same direction toward said lip and said container.

6. The urinal as set forth in claim 5 wherein said lip is defined by a plane extending transverse to the longitudinal axis of the U-shaped cross-section of said central section to locate the bottom of said lip extends longitudinally beyond the terminal ends of said lip, which terminal ends are defined by the upper extremities of said opposed walls of said central section at said receiving end.

7. The urinal as set forth in claim 6 wherein said container includes a base end for supporting said urinal upon a flat surface after use and locate said central section in an upright position to direct the collected urine into said container.

8. The urinal as set forth in claim 1 wherein said concave section of said container define in a plane parallel to said base end an hour glass shape.

* * * * *